United States Patent [19]

Isgar et al.

[11] Patent Number: 4,558,800

[45] Date of Patent: Dec. 17, 1985

[54] BAG SUPPORT SYSTEM

[76] Inventors: Charles B. Isgar, 1014 S. Ogden St., Denver, Colo. 80209; Shirley K. Isgar, 1104 Maxwell, Boulder, Colo. 80302

[21] Appl. No.: 630,494

[22] Filed: Jul. 13, 1984

[51] Int. Cl.[4] ..... B65D 25/10; B65D 25/16; B65B 67/12

[52] U.S. Cl. ..... 220/403; 220/1 T; 220/85 R; 248/95; 248/205.3

[58] Field of Search ..... 220/403, 404, 1 T, 85 R; 248/95, 97, 99, 100, 205.3

[56] References Cited

U.S. PATENT DOCUMENTS 3,261,126 7/1966 Marks ..... 248/205.3 X
3,561,077 2/1971 Grant ..... 248/95
4,062,170 12/1977 Orem .
4,332,361 6/1982 McClellan .
4,418,835 12/1983 Watts ..... 220/404

FOREIGN PATENT DOCUMENTS 2919859 11/1980 Fed. Rep. of Germany ..... 248/97
1524905 9/1978 United Kingdom ..... 248/99

*Primary Examiner*—Allan N. Shoap
*Attorney, Agent, or Firm*—Klaas & Law

[57] ABSTRACT

A support system for supporting a plastic bag in a household trash container wherein each of the plastic bags has at least two handles and an opening formed between each handle and the body of the plastic bag and wherein the support system may be located as desired so that the bottom of the plastic bag is in contact with the bottom of the container and the open end of the plastic bag is held open so that items may be deposited therein.

16 Claims, 6 Drawing Figures

BAG SUPPORT SYSTEM

FIELD OF THE INVENTION

This invention is directed to the use or reuse of plastic bags by providing a support system that fits into containers to hold the plastic bag in a functional position. This invention will allow for the use of plastic bags currently used by commercial stores to hold customer goods. These bags are provided with at least two handles so that the bag can be grasped and carried after being loaded.

BACKGROUND OF THE INVENTION

In recent years, many commercial stores have switched from paper bags for holding customer purchased goods to plastic bags. Many customers had previously used the paper bags as trash container liners however the plastic bags are formed from a limp plastic film and are not self standing, making the use of such bags difficult if not impossible in most house trash containers. Since it is highly desirable both from a cost perspective and also an environmental perspective that the customer be able to reuse these bags, efforts have been made by previous inventors to provide means for supporting these bags. In Watts (U.S. Pat. No. 4,418,835), there is disclosed a bracket that is secured to a household trash container using bolts passing through openings in the trash container and the bracket and secured to the container using nuts. Thus, Watts requires the use of skills to make the holes in the container and to attach the holder to the container. One problem associated with Watts is that the bracket is fixed in position so that it is not readily adapted for use with plastic bags having a substantially different size. Once the bracket in Watts has been installed, if a smaller plastic bag is obtained, the bottom of the plastic bag will not be in contact with the bottom of the container and if a larger plastic bag is obtained, the top of the plastic bag will not be held open. McClellan (U.S. Pat. No. 4,332,361) discloses a pair of brackets having tabs provided with openings so that the brackets may be attached to a wall or door. The brackets of McClellan have to be structurally strong since they actually support the bag and any items placed in the bag. Also, since the bottom is not supported, the bag could break. Orem (U.S. Pat. No. 4,062,170) discloses apparatus for loading plastic bags wherein the handles of the plastic bag are placed over tabs while the bottom of the plastic bag is supported on a bottom wall. Orem is similar to Watts in that it is suited only for use with one size of plastic bag.

BRIEF DESCRIPTION OF THE INVENTION

This invention provides a support system for supporting plastic bags in a household trash container wherein each of the plastic bags has at least two handles and wherein the support system may be readily located on the household trash container so as to be capable of supporting different sizes of plastic bags. Also, the support system of this invention can be used with various sizes or shapes of household containers.

In the preferred embodiment of the invention, the support system comprises an elongated member having a base and at least a pair of spaced apart projections extending outwardly from the base. The base is generally planar having a length, width and thickness and the major portion of each projection is located out of the plane of the base. Each projection is provided with an upper surface having a generally arcuately shaped extremity so that a portion of the bag handle may be readily moved thereover. A notch is located adjacent each arcuately shaped extremity so that a portion of each handle may be received and retained therein. Adhesive means are used to secure the support system to a household trash container and comprise double faced adhesive means secured to the base. The adhesive means includes the use of one or more self-sticking adhesive tapes covered by a release strip or any adhesive that may be activated when desired. When it is desired to secure the support system to a household trash container, the release strips are removed and the adhesive portion is pressed against the household trash container at a location to support a plastic bag in a desired position in the household trash container. If a different size of plastic bag is obtained, the support system may be readily moved to another location so as to properly support the different size of plastic bag by simply prying loose the adhesive means and readhering at a different location. If necessary, a new adhesive means may be applied.

It is an object of this invention to provide a support system for plastic bags for use with a conventional container, such as a household trash container, that is readily adaptable and easily applied to support different sizes of plastic bags.

It is another object of this invention to provide a support system for plastic bags for use with a conventional container, such as a household trash container, that is readily adaptable and easily applied for use with a variety of sizes or shapes of a conventional container.

It is a furtherm object of this invention to provide a support system for plastic bags for use with a conventional container, such as a household trash container, that may be readily located in any desired position so as to support the plastic bag in the conventional container so that the bottom of the plastic bag is in contact with the bottom of the conventional container so that the weight of the bag and its contents are supported by the bottom of the container and not by the bag handles and the open end of the plastic bag is held in an open position, as wide as possible, so that items may be readily deposited in the plastic bag.

Other features and advantages of the invention will be apparent from the following more particular description of preferred embodiments as illustrated in the accompanying drawing in which like reference characters refer to the same parts throughout the various views. The drawing is not necessarily to scale, emphasis instead being placed upon illustrating the principles of the invention.

DETAILED DESCRIPTION OF THE DRAWING

Figure 1:
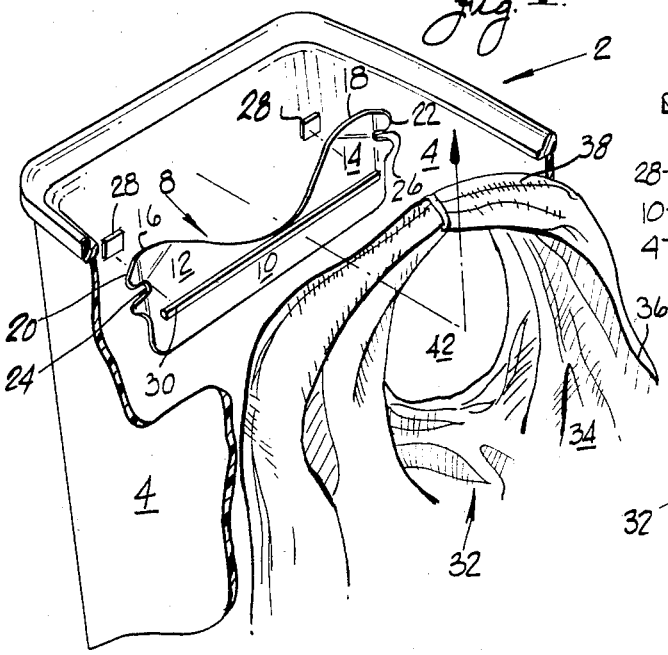
FIG. 1 is a pictorial view with parts in section various components of this invention.
Figure 2:
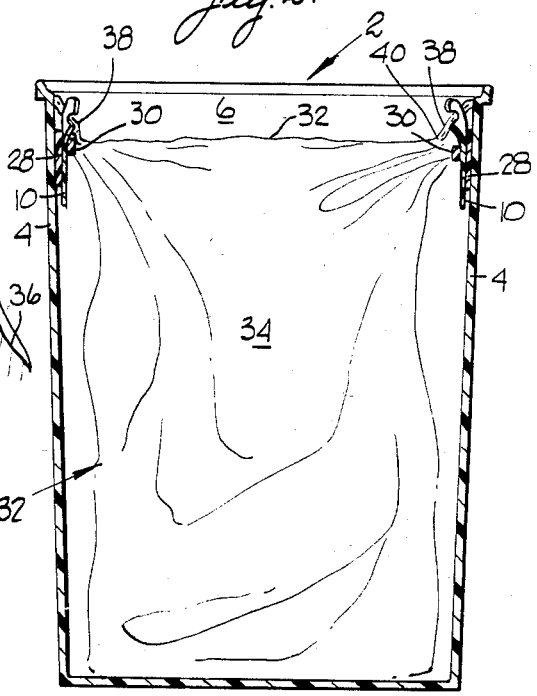
FIG. 2 is a side elevation with parts in section illustrating a plastic bag being supported in a conventional container.
Figure 3:
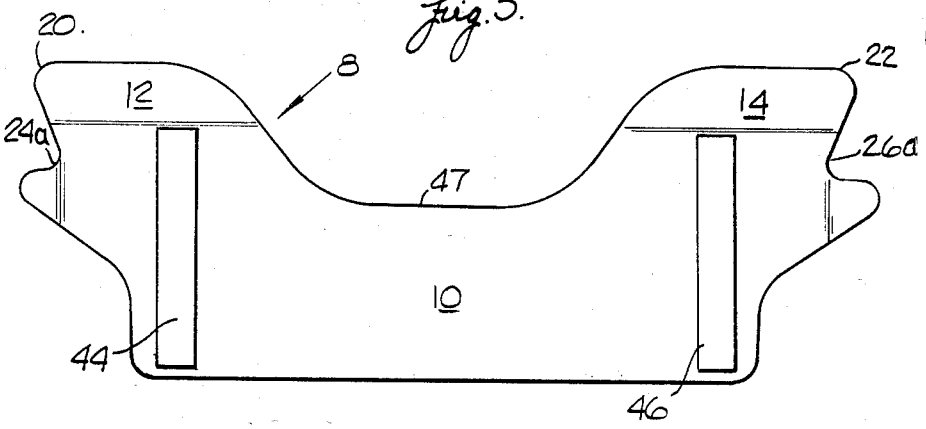
FIG. 3 is a front elevation of another embodiment of the support system of this invention.
Figure 4:
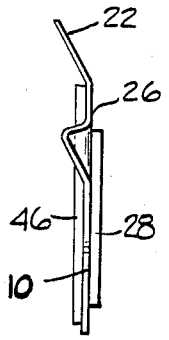
FIG. 4 is an end view of FIG. 3.

In FIGS. 1 and 2, there is illustrated a conventional container 2 which can be of a variety of sizes or shapes and which in the preferred embodiment of the invention is a plastic household trash container having a shape generally similar to an inverted frustum of a rectangular pyramid. It is to be understood that the invention may be used with containers made from other materials, such as metal. The container 2 has side walls 4 and end walls 6.

The support system comprises an elongated member 8 having a base portion 10 having a length, width and thickness. A pair of spaced apart projections 12 and 14 are integral with the base portion 10 and extend outwardly from the base portion 10. As illustrated in FIGS. 1 and 2, the base portion 10 is generally planar and the major portion of each projection is located outside the plane of the base portion 10. Each projection 12 and 14 is provided with an upper surface 16 and 18 having a generally arcuately shape extremity 20 and 22 which permits portions of a plastic bag handle, to be described below, to be readily moved thereover. Adjacent to each extremity 20 and 22, there is provided a notch 24 and 26 in which a portion of a plastic bag handle, to be described below, may be received and retained.

The means for securing the support system to the container 2 comprises a section 28 of a double faced adhesive tape which is secured at spaced locations on the base portion 10 below the projections 12 and 14. It is to be understood that the preferred embodiment uses a self-sticking adhesive covered by release strips but that other adhesive means such as adhesive that may be activated when desired. Also, one or more adhesive tapes may be used. Each section 28 has one face secured to the base portion 10 and the other face covered by a conventional release strip. When it is desired to secure the support system to the container 2, the release strips are removed and the base portion 10 is moved to the desired location on the container 2 and pressure is applied to secure the other face of the section 28 to the container 2. The base portion 10 is provided with a reinforcing rib 30 which, in the embodiment illustrated in FIGS. 1 and 2, extends in the lengthwise direction of the base portion 10. The reinforcing rib 30 is positioned on the base portion 10 so that at least a portion thereof is directly opposite each section 28. The reinforcing rib 10 functions to resist forces on the support system tending to separate the base portion 10 from the container 2. The reinforcing rib 30 may be integrally molded with the elongated member 8 or may be secured thereto in any conventional manner, such as by solvent welding.

A plastic bag 32 is illustrated in FIGS. 1 and 2 and comprises a body portion 34 having an opening 36 at one end thereof. Extending outwardly from and integral with the body portion 34 are handles 38 and 40 so that an opening 42 is formed between each handle 38 and 40 and the body portion 34. The plastic bag 32 is formed from a thin plastic material and is limp with no self-supporting characteristics.

In operation, the handles 38 and 40 are positioned around the projections 12 and 14 and portions of the handles 38 and 40 are positioned in the notches 24 and 26. This assembly is then moved into the container 2 so that the bottom of the plastic bag 32 is in contact with the bottom of the container 2. The location of the base portion 10 is marked on the container 2 and the assembly is removed from the container. The release strips are removed from the sections 28 and the base member is moved to the marked locations and pressure is applied to adhere the sections 28 and therefore the base portion 10 to the container 2. The plastic bag 32 is inserted into the container 2, and a portion of each of the handles 38 and 40 is moved over the generally arcuately shaped extremities 20 and 22 and positioned in the notches 24 and 26. When fully positioned, the bottom of the plastic bag will be in contact with and supported by the bottom of the container 2 and the plastic bag will be held in an opened and functional condition by the portions of the handles 38 and 40 retained in the notches 24 and 26 so that items may be inserted into the plastic bag 32. When the plastic bag 32 is full, the portions in the notches 24 and 26 are removed and moved over the generally arcuately shaped extremities 20 and 22, the handles 38 and 40 are grasped and the full plastic bag is removed from the container 2. Another plastic bag 32 is then supported in the container 2 following the procedures described above. It is understood that other methods may be used to secure the elongated member 8 at the desired location in the container. Also, in some instances, it may be desirable to secure the elongated members 8 in an inverted position to the outer surface of the container to utilize a bag that is larger than the container.

The above described procedures show that the support system can be used with a variety of sizes of containers 2. Also, the elongated member 8 is formed from a flexible plastic material so that it may be attached to different shapes of containers 2 such as those shaped generally as inverted frustums of a cone or a pyramid.

Other embodiments of the support system are illustrated in FIGS. 3–6. The reference numerals used in association with FIGS. 1 and 2 will be used with similar portions of the embodiments in FIGS. 3–6. Thus, in FIGS. 3 and 4, there is an elongated member 8 having a body portion 10, projections 12 and 14 having upper surfaces 16 and 18, generally arcuately shaped extremities 20 and 22 and double faced adhesive sections 28. The notches **24*a* and 26*a* are shaped differently from the notches 24 and 26 of FIGS. 1 and 2 in that the notches 24*a* and 26*a* project inwardly for only a relatively small distance. When a portion of the handle 38 or 40 of the bag 32 is located in the notches 24*a* and 26*a*, another portion of the handle 38 or 40 will be located between the projections 12 and 14 and a space will exist between the another portion of the handle 38 or 40 and the edge 47 of the base 10 between the projections 12 and 14. When the bag 34 in the container 2 is full, the another portion of each handle 38 or 40 is grasped and moved upwardly. Because of the shape of the notches 24*a* and 26*a*, the portions of the bag in the notches 24*a* and 26*a* will automatically move out of the notches 24*a* and 26*a* as the bag 32 is moved upwardly. The reinforcing means is different in that it comprises two reinforcing ribs 44 and 46, each of which extends in a widthwise direction of the base portion 10. As in the embodiment of FIGS. 1 and 2, each reinforcing rib 44 and 46 is positioned on the base portion 10 so that at least a portion thereof is directly opposite each section 28. The reinforcing ribs 44 and 46 also function to resist forces on the support system tending to separate the base portion 10 from the container 2. The reinforcing ribs 44 and 46 are preferably integrally molded with the elongated member 8 but may comprise separate strips secured to the elongated member 8** by conventional means, such as solvent welding.

Figure 5:
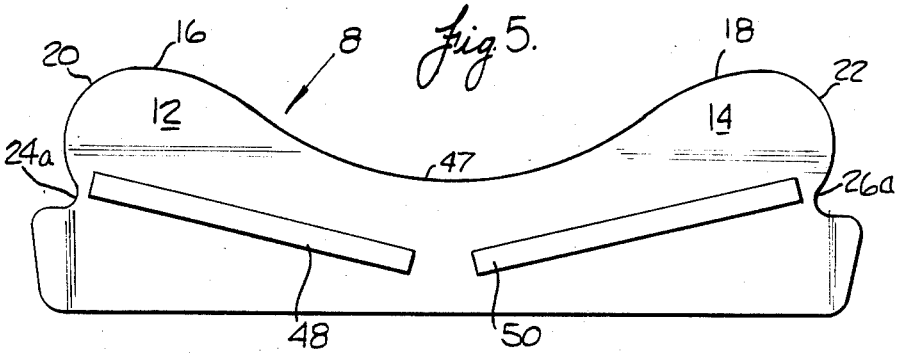
FIG. 5 is a front elevation of still another embodiment of the support system of this invention.
Figure 6:
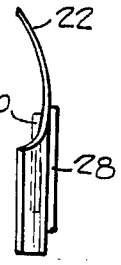
FIG. 6 is an end view of FIG. 5.

In the embodiment illustrated in FIGS. 5 and 6, there is an elongated member 8 having a body portion 10, projections 12 and 14 having upper surfaces 16 and 18, generally arcuately shaped extremities 20 and 22 and double faced adhesive sections 28. The notches 24*a* and 26*a* in FIGS. 5 and 6 are similarly shaped as in FIGS. 3 and 4 and function in the same manner so that the portion of the handle moves automatically out of the notches 24*a* or 26*a* when the bag is moved upwardly. The reinforcing means is different in that it comprises two reinforcing ribs 48 and 50, each of which extends in a diagonal direction relative to the base portion 10. As in the embodiments of FIGS. 1–4, each reinforcing rib 48 and 50 is positioned on the base portion 10 so that at least a portion thereof is directly opposite each section 28. The reinforcing ribs 48 and 50 also function to resist forces on the support system tending to separate the base portion 10 from the container 2. The reinforcing ribs 48 and 50 are preferably integrally molded with the elongated member 8 but may comprise separate strips secured to the elongated member 8 by conventional means, such as solvent welding.

While the preferred embodiments of the invention have been illustrated and described herein, it may be otherwise embodied and practiced within the scope of the following claims.

What is claimed is:

1. In a plastic bag support system for use in supporting a plastic bag in a container wherein the plastic bag has at least two handles adjacent the open end thereof and wherein each handle forms an opening between the handle and the body of the plastic bag, the improvement comprising:

an elongated, upstanding, sheet-like base;

at least a pair of spaced apart projections extending upwardly and outwardly from said base and having portions not in the plane of adjacent portions of said base;

adhesive means comprising double faced adhesive tapes secured to spaced apart portions of said base for securing said base to said container with said projections adjacent the open end of said container;

means on said projections for receiving at least a portion of at least one of said handles when said base is secured to said container to retain said handle in a position between said projections and said container; and reinforcing means adjacent at least said spaced apart portions to resist forces tending to separate said base from said container when said base is secured to said container.

2. In a plastic bag support system for use in supporting a plastic bag in a container wherein the plastic bag has at least two handles adjacent the open end thereof and wherein each handle forms an opening between the handle and the body of the plastic bag, the improvement comprising:

an elongated, upstanding, sheet-like base;

at least a pair of spaced apart projections extending upwardly and outwardly from said base and having portions not in the plane of adjacent portions of said base;

adhesive means comprising at least one double face adhesive tape with one face secured to said base for securing said base to said container with said projections adjacent the open end of said container;

means on said projections for receiving at least a portion of at least one of said handles when said base is secured to said container to retain said handle in a position between said projections and said container;

said means on said projections including an upper surface having a generally arcuately shaped extremity so that portions of said one of said handles may be readily moved thereover; and at least one notch adjacent to said generally arcuately shaped extremity for receiving a portion of said one of said handles.

3. Apparatus as in claim 2 wherein said elongated base comprises:

a semi-rigid, flexible plastic.

4. Apparatus as in claim 3 wherein:

said base is generally planar.

5. Apparatus as in claim 4 and further comprising: reinforcing means adjacent at least said spaced apart portions to resist forces tending to separate said base from said container when said base is secured to said container.

6. Apparatus as in claim 5 wherein:

said base has a length, width, and thickness;

said reinforcing means comprises an elongated rib on said base; and said elongated rib extends in a lengthwise direction on said base.

7. Apparatus as in claim 5 wherein:

said base has a length, width and thickness;

said reinforcing means comprises two elongated ribs on said base; and each of said elongated ribs extends in a widthwise direction on said base.

8. Apparatus as in claim 5 wherein:

said base has a length, width and thickness;

said reinforcing means comprises two elongated ribs on said base; and each of said elongated ribs extends in a diagonal direction on said base.

9. Apparatus as in claim 2 wherein:

said base is secured to said container.

10. Apparatus as in claim 9 wherein:

said container is shaped generally as a frustum of a cone.

11. Apparatus as in claim 9 wherein:

said container is shaped generally as a frustum of a rectangular pyramid.

12. Apparatus as in claim 2 wherein:

said base has a length, width and depth; and the distance between said arcuately shaped surfaces of said projections is greater than the length of said base.

13. Apparatus as in claim 2 wherein:

said base has a length, width and thickness; and the distance between said arcuately shaped surfaces of said projections is less than the length of said base.

14. Apparatus as in claim 5 wherein:

said base is secured to said container so that the bottom of said plastic bag is in contact with the bottom of said container; and said notches are spaced apart a distance so that said plastic bag is held open so that items may be placed therein.

15. Apparatus as in claim 5 and further comprising:

means between said notches and said arcuately shaped surfaces so that a portion of said handle in each of said notches will automatically move out of each of said notches when said handles are grasped and the bag is moved in a vertical direction.

16. Apparatus as in claim 15 wherein:

said means for automatically moving said portion of said handle out of said notch comprises the shape of the surface between each of said notches and each of said arcuately shaped surfaces.

* * * * *